US005111979A

United States Patent [19]

Athar

[11] Patent Number: 5,111,979

[45] Date of Patent: May 12, 1992

[54] FLUID DISPENSING CONTAINER

[76] Inventor: Ali Athar, 4698 Hwy. 124, Hoschton, Ga. 30548

[21] Appl. No.: 470,258

[22] Filed: Jan. 25, 1990

[51] Int. Cl.[5] ..... B65D 25/40

[52] U.S. Cl. ..... 222/568; 222/520; 222/465.1; D9/528

[58] Field of Search ..... 222/568, 545, 519, 520, 222/465.1; 215/100 A, 1 R, 100 R; 220/85 SP, 94 A; D9/367, 375, 376, 378, 389, 403

[56] References Cited

U.S. PATENT DOCUMENTS

D. 291,535 8/1987 Lyons ..... D9/376
D. 292,885 11/1987 Best et al. ..... D9/376
D. 302,946 8/1989 Cramer ..... D9/378
D. 308,633 6/1990 Irvine ..... D9/378

*Primary Examiner*—Andres Kashnikow

*Assistant Examiner*—Christopher G. Trainor

*Attorney, Agent, or Firm*—Leon Gilden

[57] ABSTRACT

A container is set forth for use particularly in dispensing of large volumes of fluid, wherein the container includes a planar forward wall, a planar floor, planar side wall panels, including upper arcuate side wall portions directed upwardly towards a top wall, the back wall of the container includes a plurality of rearwardly directed panels directed from the top wall downwardly to the floor, wherein an elongate generally "U" shaped handle extends from the top wall adjacent a pouring spout mounted within the top wall to an intersection defined by a lower rear wall panel and the floor to permit positioning of an individual's hand about the handle. The pouring spout is positioned adjacent the forward wall and includes a further pouring spout mounted therethrough to permit accommodation of various fluid flows through the pouring spout organization.

1 Claim, 4 Drawing Sheets

PRIOR ART

FIG 7
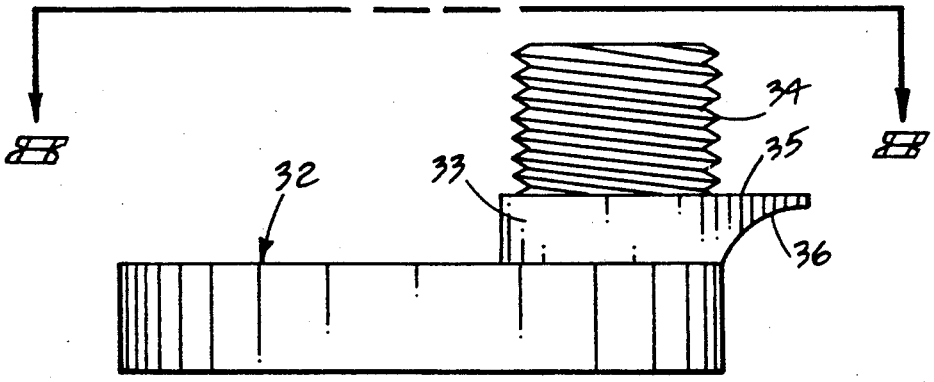
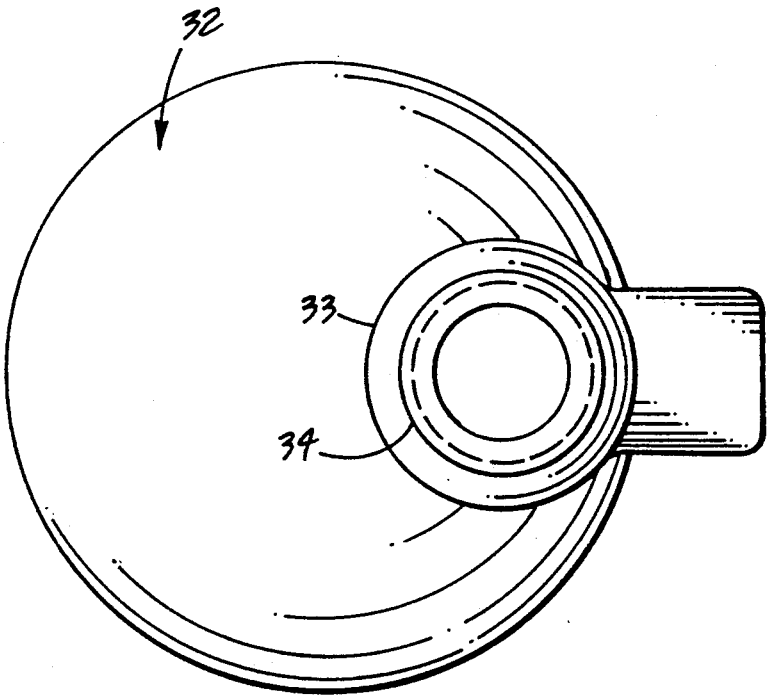
FIG 8

FLUID DISPENSING CONTAINER

BACKGROUND OF THE INVENTION

1. Field of the Invention

The field of invention relates to fluid containers, and more particularly pertains to a new and improved fluid dispensing container wherein the same is arranged and configured for accommodating various degrees of fluid flow from enlarged capacity containers.

2. Description of the Prior Art

Containers of various configurations have been developed in the prior art to permit directing of flow therethrough. The prior art, however, has heretofore not completely addressed the need for enabling individuals to accommodate fluid flow from enlarged containers containing an increased quantity of such fluid. Particularly with a redistribution of weight of fluid flow from within a container during its pouring, as well as a need for utilizing various quantities of flow from an associated container, redistribution of an individual's grip in association with a container is often necessary. Examples of the prior art include U.S. Pat. No. 4,643,825 to Weslowki wherein a filling system is provided within shipping containers, wherein the shipping containers include a threaded plug containing a plurality of variously sized plugs for use with the shipping containers. The organization, as opposed to the instant invention, fails to address a need as does the instant invention in providing variously sized dispensing openings from a container, as well as coupling such openings with appropriate positioning relative to the container in association with a properly configured handle.

U.S. Pat. No. 4,106,665 to Cannon sets forth a closure for a liquid container wherein the closure is positioned adjacent a forward end of the container, with a pivotal handle overlying the upper end of the cylindrical container.

U.S. Pat. No. 3,385,461 to Mallin sets forth a reusable container wherein various portions of the container are severable, one from the other, to permit repositioning of a lid of the container overlying the remaining portions.

U.S. Pat. No. 4,449,640 to Finkelstein wherein a dispensing container includes a spout positioned adjacent a forward wall of the cylindrical container absent in a handle or container configuration to direct flow relative to the spout.

U.S. Pat. No. 3,672,547 to Kozlowski sets forth a lid for a paint can, wherein the lid includes a circular opening positioned adjacent a side wall of the container, with a removable plug for receiving a pouring spout within the opening upon removal of the plug.

As such, it may be appreciated that there continues to be a need for a new and improved fluid dispensing container wherein the same addresses both the needs of enabling manual repositioning of an individual's hand relative to the handle of the container, as well as configuring the container to direct flow to the spout associated with the container and in this respect, the present invention substantially fulfills this need coupling the construction of the container with a spout permitting variable quantities of flow therethrough.

SUMMARY OF THE INVENTION

In view of the foregoing disadvantages inherent in the known types of fluid containers now present in the prior art, the present invention provides a fluid dispensing container wherein the same directs flow of fluid within the container to a spout positioned within a top wall of the container and enables convenience of manual repositioning in grasping of a handle provided by the container to accommodate redistribution of fluid within the container during a pouring procedure. As such, the general purpose of the present invention, which will be described subsequently in greater detail, is to provide a new and improved fluid dispensing container which has all the advantages of the prior art fluid containers and none of the disadvantages.

To attain this, the present invention includes a container for use particularly in dispensing of large volumes of fluid, wherein the container includes a planar forward wall, a planar floor planar side wall panels, including upper arcuate side wall portions directed upwardly towards a top wall, the back wall of the container includes a plurality of rearwardly directed panels directed from the top wall downwardly to the floor, wherein an elongate generally "U" shaped handle extends from the top wall adjacent a pouring spout mounted within the top wall to an intersection defined by a lower rear wall panel and the floor to permit positioning of an individual's hand about the handle. The pouring spout is positioned adjacent the forward wall and includes a further pouring spout mounted therethrough to permit accommodation of various fluid flow through the pouring spout organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluid dispensing container which has all the advantages of the prior art fluid containers and none of the disadvantages.

It is another object of the present invention to provide a new and improved fluid dispensing containers which may be easily and efficiently manufactured and marketed.

It is a further object of the present invention to provide a new and improved fluid dispensing containers which is of a durable and reliable construction.

An even further object of the present invention is to provide a new and improved fluid dispensing container which is susceptible of a low cost of manufacture with regard to both materials and labor, and which accordingly is then susceptible of low prices of sale to the consuming public, thereby making such fluid dispensing containers economically available to the buying public.

Still yet another object of the present invention is to provide a new and improved fluid dispensing container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic side view taken in elevation of a further modified cap of the instant invention.

FIG. 8 is a top orthographic view of the cap, as illustrated in FIG. 7.

DESCRIPTION OF THE PREFERRED EMBODIMENT

Figure 1:
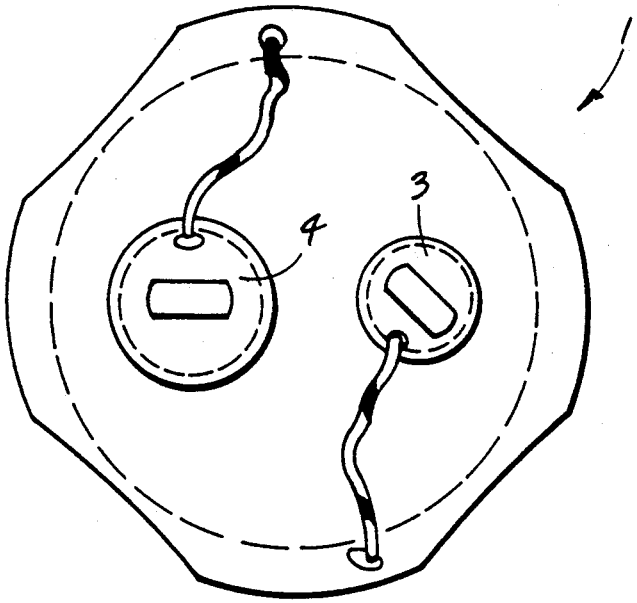
FIG. 1 is a top orthographic view of a prior art fluid dispensing cap.

With reference now to the drawings, and in particular to FIGS. 1 to 8 thereof, a new and improved fluid dispensing container embodying the principles and concepts of the present invention and generally designated by the reference numeral 10 will be described.

Figure 2:
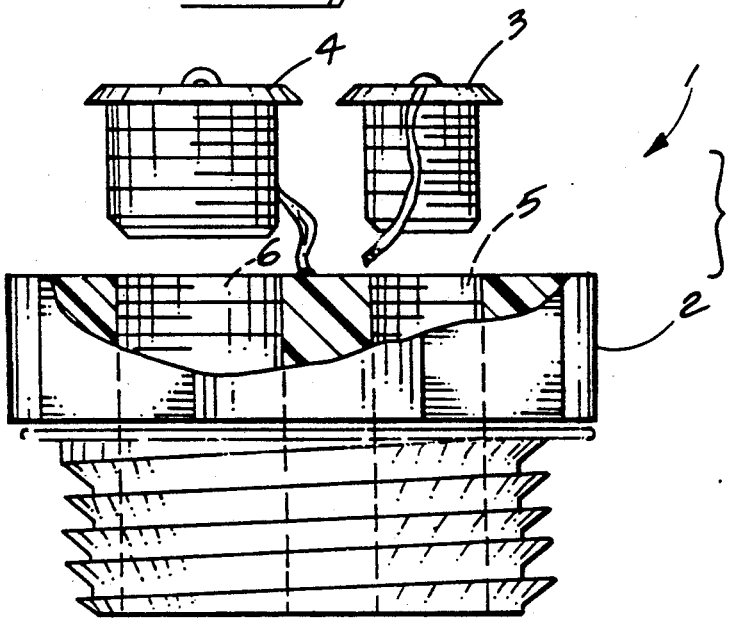
PRIOR ART Fig 2
FIG. 2 is an orthographic side view taken in elevation of the cap as illustration in FIG. 1.
Figure 3:
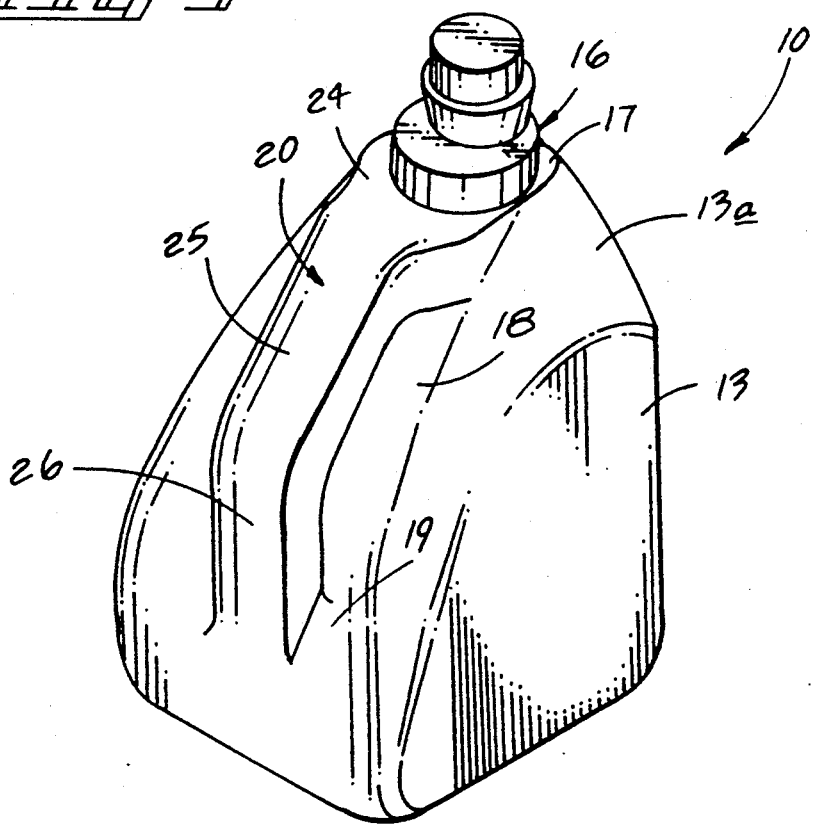
FIG. 3 is an isometric illustration of the instant invention.
Figure 4:
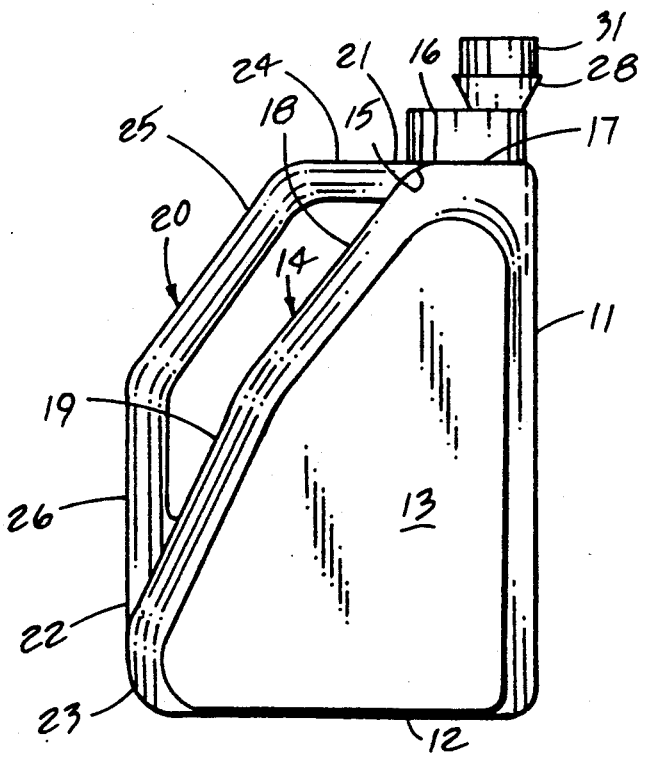
FIG. 4 is an orthographic side view taken in elevation of the instant invention.
Figure 5:
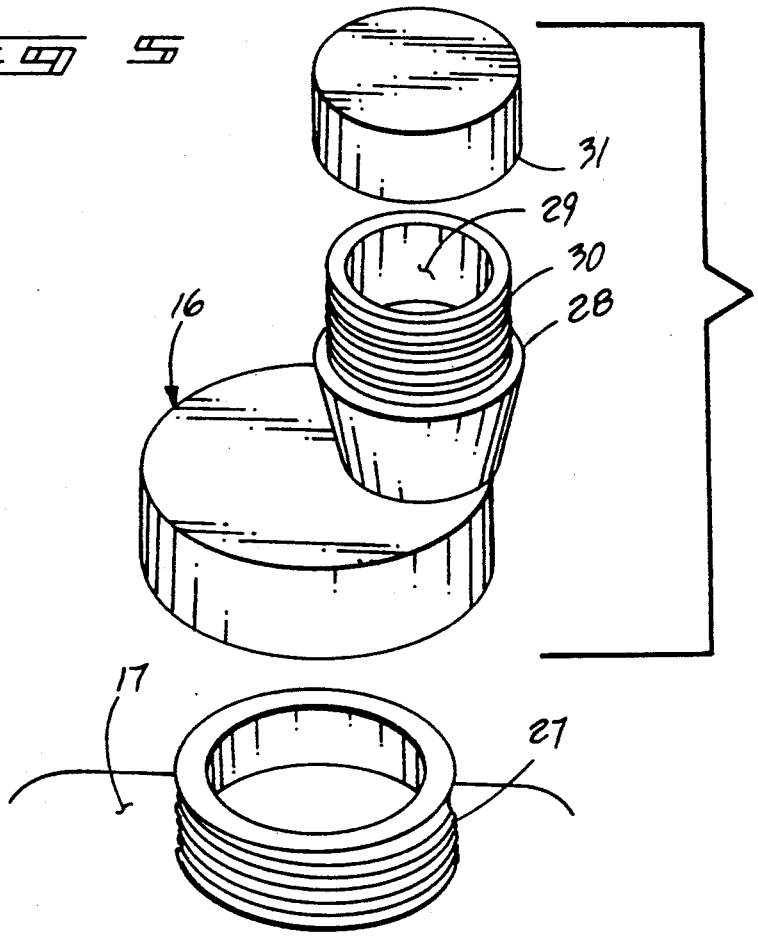
FIG. 5 is an isometric exploded view of the pouring and dispensing cap of the instant invention relative to the container.

FIG. 1 illustrates a prior art cap 1, wherein a plurality of dispensing plugs defined by a first plug 3 and a second plug 4 are receivable within respective apertures 5 and 6, as illustrated in FIG. 2, to provide directing of varying quantities of flow therethrough. The relative alignment of the openings 5 and 6 relative to the container are not directed as is the instant invention.

More specifically, the fluid dispensing container 10 of the instant invention essentially comprises a planar forward wall 11 with a planar floor 12 mounted orthogonally thereto. The container further includes spaced planar side wall panels 13, with the panels 13 including arcuate upper side wall panel portions **13*a* that channel fluid from within the interior of the container to the top wall 17. The planar forward wall 11 is aligned with a forward surface of a dispensing cap 16, and further aligned with a cap pouring spout 28 mounted orthogonally through a top surface of the cap 16. The rear wall 14 of the container is defined by an upper end 15 mounted in alignment with a rear end of the dispensing cap 16, wherein the upper end 15 is defined by an outwardly directed, upper rear panel 18 that slopes outwardly and rearwardly to a lower rear panel 19 that is directed downwardly and rearwardly to a rear arcuate edge 23 that defines an intersection between the floor 12 and a lower portion of the rear panel 19. A handle 20 overlies the rear wall 14 and extends from the upper end 15 downwardly and rearwardly to the rear arcuate edge 23, and is defined by an intermediate handle leg 25, with a handle top leg 24 directed from the intermediate leg 25 to the upper end 15 and lies parallel to the floor 12. The handle further includes a bottom handle leg 26 that is directed from the intermediate leg 25 downwardly to the intersection 23. The handle 20, in this manner, enables a user of the container to reposition a grip in a myriad of positions along the handle from the top leg 24 during a support position to the intermediate leg 25 during a tilting position, and then downwardly to the bottom leg 26** to complete emptying of contents from within the container.

The cap 16 includes an internally threaded annular skirt securable to an externally threaded hollow cylindrical boss 27 formed and directed orthogonally through the top wall 17 of the container. The dispensing cap 16 includes a spout bore 29 directed through the cap pouring spout 28, with a forward wall thereof positioned in alignment with an interior surface of the forward wall 11. The bore 29 includes a threaded upper end 30 formed thereabout for receiving a spout cap 31 thereabout to sealingly secure and isolate the bore 29 during periods of non-use.

Figure 6:
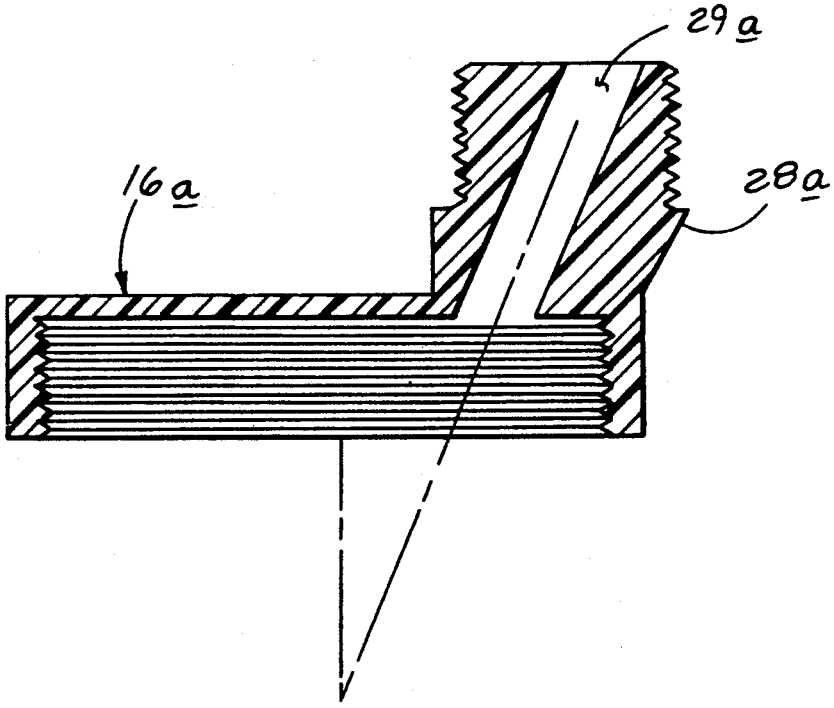
FIG. 6 is an orthographic cross-sectional view of a modified dispensing cap utilized by the instant invention.

Reference to FIG. 6 illustrates a modified spout cap **16*a* formed with a cap pouring spout 28 directed orthogonally and upwardly from a top wall of the cap 16*a*, with a modified spout bore 29 directed diagonally through the pouring spout 28 whose axis bisects an axis defined by the cap 16*a* at a position below the cap 16*a*, as illustrated in FIG. 6**, to provide directing of fluid from within the container exteriorly and in a direction spaced from the container during a pouring procedure.

A further modified cap 32 is illustrated in FIG. 7 formed with a pouring spout boss 33 directed upwardly from the planar top wall of the cap 32 that includes a threaded spout projection 84 for receiving the spout cap 31. A top planar wall of the boss 33 extends beyond the cap 32 and terminates in a forward projection that includes a concave bottom surface 36 intersecting the projection of the top wall 35 at an upper end and the top wall of the cap 32 at its lower end to receive an individual's finger or hand thereto to assist in securement of the container during a pouring operation.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fluid dispensing container including a planar floor, a forward planar wall orthogonally mounted to the floor, spaced parallel planar side wall panels orthogonally mounted to the floor, and a top wall secured to the forward wall, and arcuate side wall portions extending from each side wall panel upwardly to the top wall, and a rear wall extending from the top wall downwardly and rearwardly from the top wall to the floor, and a cylindrical boss orthogonally directed through the top wall including a spout opening, and including a handle mounted to the rear wall, wherein the handle is mounted in alignment with the top wall at an upper end and mounted at its lower end to a lower portion of the rear wall, and wherein a top portion of the handle is oriented parallel to the floor, with a rear portion of the handle oriented parallel to the forward wall, and wherein the spout opening includes a forward surface aligned with an interior surface of the forward wall, and pouring spout including a pouring cap, the pouring cap including an internally threaded skirt threadedly securable to the cylindrical boss, and the pouring cap including a top planar wall, and wherein the pouring cap includes a cap pouring spout mounted to the top planar wall and having a spout bore having a diameter substantially less than that of a cap diameter defined by the cap, and wherein the spout bore is arranged diagonally relative to the spout opening and the cap pouring spout bore includes a pouring spout axis intersecting a cap axis below the top planar wall, and wherein the cap pouring spout includes a second cap securable to the cap pouring spout, and wherein the cap pouring spout includes a boss member spaced above the planar top wall of the cap, and wherein the boss member includes a planar floor portion, the planar floor portion extending forwardly and beyond the cap top planar wall terminating in a projection, the projection including a concave bottom surface directed from the projection downwardly intersecting a forward portion of the cap.

* * * * *